United States Patent [19]

Strutz

[11] 3,964,653

[45] June 22, 1976

[54] PADDED CARRYING STRAP CONSTRUCTION

[75] Inventor: Glenn L. Strutz, Madras, Oreg.

[73] Assignee: Tote Pak Co., Madras, Oreg.

[22] Filed: Sept. 18, 1974

[21] Appl. No.: 506,965

Related U.S. Application Data

[62] Division of Ser. No. 379,716, July 16, 1973, Pat. No. 3,882,914.

[52] U.S. Cl. ..... 224/5 P; 224/5 Q

[51] Int. Cl.[2] ..... A45C 1/04

[58] Field of Search ..... 224/45.8, 47, 49, 58, 224/1.1, 2.2, 5.9, 5 P, 5.15–5.17, 5.22, 5.26; 150/1.5 R; 190/57, 58

[56] References Cited

UNITED STATES PATENTS

| | | | |
|---|---|---|---|
| 1,203,095 | 10/1916 | Bristow | 150/1.5 R |
| 2,008,759 | 7/1935 | Howard | 150/1.5 R |
| 2,598,143 | 5/1952 | Smith | 224/1 A |
| 2,609,898 | 9/1952 | Finkelstein | 190/58 R |
| 2,676,737 | 4/1954 | Zirbel | 224/5 P |
| 3,799,227 | 3/1974 | Cantwell | 150/1.5 R |

FOREIGN PATENTS OR APPLICATIONS

| | | | |
|---|---|---|---|
| 527,910 | 10/1940 | United Kingdom | 224/5 P |
| 521,222 | 5/1940 | United Kingdom | 224/5 P |

*Primary Examiner*—Albert J. Makay
*Assistant Examiner*—Kenneth Noland
*Attorney, Agent, or Firm*—Klarquist, Sparkman, Campbell, Leigh, Hall & Whinston

[57] ABSTRACT

A carrying strap comprises a resilient foam padding layer sandwiched between inner and outer surface strips of soft pliable simulated leather material, with an inner load-bearing layer of tightly woven high-strength webbing extending across the full width of the strap between the foam padding and the outer surface layer. Side edge caps enclose the side edge portions of the surface layers and webbing, and side stitching secures the caps, surface layers and webbing together throughout the length of the strap. The opposite ends of the strap are attached to a carrying bag by a pair of side-by-side rivets extending through the surface layers and webbing of the strap, through the bag material and through a leather backing patch on the inside surface of the bag material. Cross-stitching through the strap ends, bag and backing patch below the rivets prevents the strap from twisting on the rivets.

12 Claims, 7 Drawing Figures

PADDED CARRYING STRAP CONSTRUCTION

This is a division, of application Ser. No. 379,716 filed July 16, 1973, now U.S. Pat. No. 3,882,914.

BACKGROUND OF THE INVENTION

1. Field of the Invention

The present invention relates to a carrying strap construction.

2. Description of the Prior Art

In the typical carrying strap for, for example, a golf bag or backpack, a narrow strap of leather or canvas is used as the primary load-bearing member, with a wider and thicker layer of foam or other suitable padding placed between the strap and the wearer's shoulder. The narrow strap, when loaded, bites into the padding, forcing the padding against the wearer's shoulder only across a narrow band corresponding to the width of the strap, thereby concentrating the load in a small area of the shoulder, which tends to lead to early fatigue and soreness. Accordingly there is a need for a carrying strap which distributes and transmits the supported load across the full padded width of the strap.

SUMMARY OF THE INVENTION

The present invention is a padded carrying strap construction designed to distribute the supported load across the full padded width of the strap to minimize the concentration of stress on the wearer's shoulders.

The carrying strap construction of the invention is prrticularly suited for manufacture with and attachment to vinyl materials in that the construction minimizes tearing strains on the strap and at the points of attachment of the strap to a carrying bag.

An important feature of the strap construction is a wide and thick inner layer of foam padding sandwiched between thin, soft and pliable surface layers, and with a thin but strong and relatively non-stretchable load-bearing member extending the full width of the padding between the padding and one of the surface layers.

In summary, primary objects of the invention include provision of:

- a carrying strap construction particularly suited for use with vinyl materials;
- a strap construction that distributes the load evenly across the full padded width of the strap to minimize fatigue;
- a strap construction that has a wide variety of load-bearing applications in conjunction with golf bags, carrying bags and numerous other load-lifting applications;
- a strap construction that maintains the desired shape of the strap;
- a strap construction that will not stretch;
- a strap construction that is simple and economical to manufacture; and
- a strap construction that is comfortable to the wearer.

The foregoing and other objects, features and advantages of the present invention will become more apparent from the following detailed description which proceeds with reference to the accompanying drawings showing one form of the strap.

DETAILED DESCRIPTION

Figure 1:
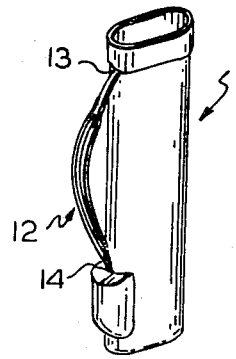
FIG. 1 is an elevational view of a golf bag having a strap of the present invention attached to it.

With reference to the drawings, FIG. 1 shows a golf bag 10 made of a vinyl material and having a carrying strap 12 made in accordance with the invention attached to it. The strap is attached at a first attaching point 13 near the top of the bag and at a second attachment point 14 at an intermediate position along the length of the bag.

Figure 2:
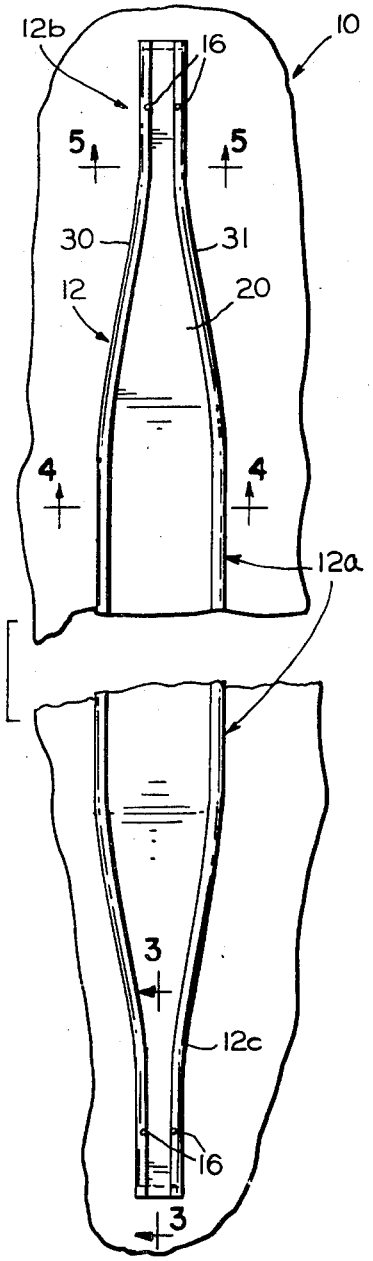
FIG. 2 is a foreshortened plan view of the strap of FIG. 1.

The outer face of the strap is shown in FIG. 2, revealing its overall shape. The strap includes a relatively wide padded load-bearing portion 12*a* extending throughout a major intermediate portion of its length with such portion tapering inwardly to narrow upper and lower unpadded end portions 12*b*, 12*c*, respectively. The end portions are attached to the bag material 10 by attaching means including a pair of rivets 16. Such attaching means is shown in greater detail in FIGS. 3, 6 and 7 and will be described in greater detail hereinafter.

Figure 4:
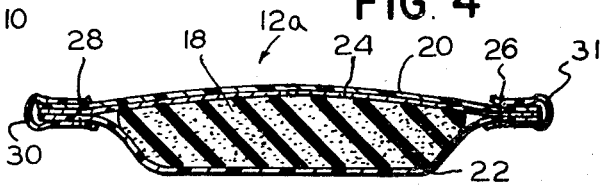
FIG. 4 is a cross-sectional view through the strap taken along the line 4—4 of FIG. 2.

Referring to FIG. 4, the padded intermediate portion of the strap includes a relatively wide and thick filler layer or core of a resilient sponge-like foam material 18. This layer is covered on its opposite sides by thin, soft, pliable outer and inner surface strips 20, 22 of a leather-like material such as vinyl or cloth-backed vinyl. A wide strip 24 of high-strength, tightly woven canvas webbing or the equivalent lies between the foam filler 18 and the outer surface layer 20. This webbing extends substantially flat throughout the full width of the strap. The primary function of the webbing is to carry and distribute the loads transmitted to the strap and to maintain its width and length dimensions. Thus, this load-bearing inner layer should be made of high-strength material that resists stretching. The tightly woven canvas webbing commonly used in upholstered furniture construction is ideal for this purpose.

The opposite side edge portions of the surface layers and inner webbing layer extend beyond the opposite sides of the foam padding layer 18. These side edge portions are stitched together by edge stitching 26, 28 which extends throughout the full length of the strap. The opposite side edge portions of the surface layers and inner webbing layer are covered by edge caps 30, 31, preferably of the same material as the outer surface layers. These caps are attached to the edge portions of the surface and webbing layers by the aforementioned edge stitching. The stitching not only fastens the surface layers together to define an enclosure within which the foam padding 18 is received and retained, but also serves to maintain the inner webbing layer 24 in a substantially flat condition to prevent its bunching and buckling in use. Thus the stitching ensures that any load transmitted to the strap will be distributed across substantially the full width of the webbing, and from the webbing through the full width of the padding in a wide band to the wearer's shoulders to minimize the unit loading on the shoulders.

Figure 5:
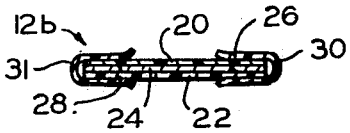
FIG. 5 is a cross-sectional view taken along the line 5—5 of FIG. 2.
Figure 3:
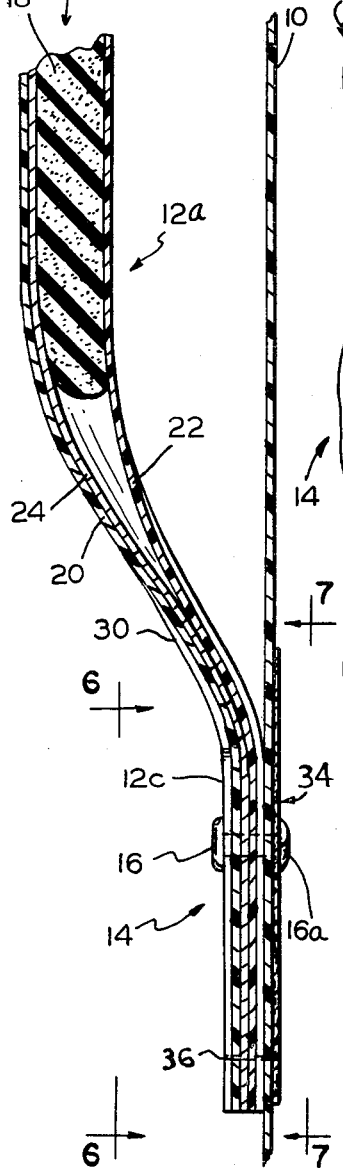
FIG. 3 is an enlarged sectional view through the lower strap connection to the bag taken along the line 3—3 of FIG. 2.

FIGS. 3 and 5 show the lower unpadded end portion 12c of the strap, which is identical in construction to the upper end portion **12*b*. Such portions eliminate the foam padding 18, although this is not essential, and instead include only the thin, high-strength, inner webbing layer 24 between the outer and inner surface layers 20, 22. As in the padded intermediate portion of the strap, the webbing layer extends the full width of the surface layers in these end portions. The end caps 30, 31 continue throughout the end portions of the strap, as does the previously mentioned stitching 26, 28,** securing the end caps, surface layers and webbing layer together.

Figure 6:
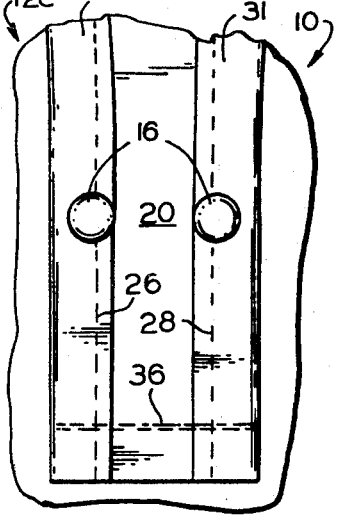
FIG. 6 is a plan view of the lower strap connection to the bag taken approximately along the line 6—6 of FIG. 3.
Figure 7:
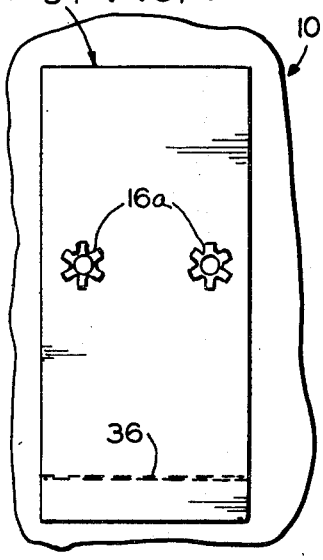
FIG. 7 is a view looking toward an inside surface portion of the bag at the lower strap connection, taken along the line 7—7 of FIG. 3.

The means for attaching the end portions of the strap to the vinyl bag 10 will now be described in detail with reference to FIGS. 3, 6 and 7. The pair of side-by-side rivets 16 penetrate the two surface layers and inner webbing layer of the strap as well as the vinyl material 10 of the bag. The rivets also penetrate a leather backing patch member 34 before being clinched at 16a against the outer surface of the patch to compress together the strap layers, bag material and patch. From FIG. 6 it will be noted that the rivets actually extend through the edge caps 30, 31 of the strap, thereby providing further reinforcement of the strap against any tendency of the rivets to tear the vinyl strap material. Below the rivets 16, that is, in a direction toward the terminal end of the strap, the two surface layers and webbing layer of the strap are cross-stitched to the bag by double stitching 36. Such stitching extends across the width of the strap and through both the bag layer 10 and the backing patch 34.

The purpose of the backing patch is, of course, to prevent the rivets from pulling through the vinyl bag material. To best fulfill this function, the patch should be securely bonded with a suitable adhesive to the inside of the bag. Thus the patch becomes an integral part of the bag and distributes rivet-induced stress to a wide area of the bag to minimize unit stresses on the bag material. Because of the placement of the rivets relative to the cross-stitching 36, the rivets bear the entire load at the strap connections to the bag. The purpose of the stitching is to prevent the strap from twisting about the rivets and producing any sort of a tearing or shearing action. Thus the leather backing patch permits the strap to twist, pull and turn without cutting or tearing the vinyl bag material.

In testing the above-described attaching means, it has been found that backing patch materials other than leather, such as plastics, canvas and even metals, do not provide the stability and resistance against pull-out under heavy or sudden loading that leather provides. Furthermore it has been found that monolithic full thickness of leather is preferred to split leather for the backing patch material in carrying out the purposes of the patch.

As previously suggested, materials other than vinyl can be used for the surface layers 20, 22 of the strap construction so long as such materials have the desirable soft pliable characteristics of vinyl. Similarly, any resilient soft padding material can be used in place of the preferred plastic sponge-like foam if desired. The webbing used is a high-strength material that is resistant to any substantial stretching and is the primary load-bearing and shape-maintaining component of the strap. Any substitute material should have similar characteristics.

The strap can be manufactured in any width and length for a wide variety of uses and for supporting widely varying load capacities, wherever it is important to provide a protective padding for the load. Possible applications other than for golf bags, tote bags and backpacks would include lifting slings for lifting race horses when they are crippled or for lifting heavy commercial and industrial loads such as furniture where it is important not to mar the load.

Having illustrated and described a preferred embodiment of the invention, it should be apparent to those skilled in the art that the same permits of modification in arrangement and detail. I claim as may invention all such modifications as come within the true spirit and scope of the following claims.

I claim:

1. A carrying strap construction comprising:

a first thin, soft, pliable strip forming a first surface layer of said strap;

a second thin, soft, pliable strip overlying said first strip and forming a second surface layer of said strap;

a resilient layer of padding material of greater thickness than said surface layers sandwiched between said surface layers;

a thin, flexible strip of high-strength material resistant to stretching forming an inner load-bearing layer of said strap between said padding layer and one of said surface layers and extending across the full width of said padding layer, said inner load-bearing layer having substantially the same overall width edge-to-edge of said strap as the adjacent said surface layer, and edge securing means securing together said first and second surface layers and said load-bearing inner layer at the opposite side edge portions of said strap and along the length thereof to bind together said surface and inner layers and enclose said layer of padding, such that said surface and inner layers extend together throughout substantially the full width and length of said strap end securement means attaching said surface layers and said load bearing inner layer to each other at their ends and for attachment to a load carrying means

2. A construction according to claim 1 wherein said opposite side edge portions of said strap are covered with edge caps overlying said first and second surface layers, said stitching securing together said edge caps, first and second surface layers and said load-bearing inner layer.

3. A construction according to claim 1 wherein said surface layers are composed of a soft pliable leather-like vinyl material.

4. A construction according to claim 1 wherein said high-strength inner layer comprises a tightly woven canvas webbing.

5. A construction according to claim 1 wherein said surface layers comprise cloth-backed vinyl material, said load-bearing inner layer comprises a tightly woven canvas webbing and said padding layer comprises a resilient sponge-like foam material.

6. A construction according to claim 2 wherein said edge caps and surface layers comprise a vinyl material and said load-bearing inner layer comprises a tightly woven cloth webbing.

7. A construction according to claim 1 wherein said padding layer terminates short of opposite end portions of said strap such that said end portions include only said load-bearing inner layer between said surface layers.

8. A construction according to claim 1 wherein one of said first and second surface layers comprises a body-engaging inner surface layer and the other said surface layer comprises an outer surface layer, said load-bearing inner layer lying between said padding layer and said outer surface layer.

9. A construction according to claim 8 wherein said inner and outer surface layers and said load-bearing inner layer extend the full width of said strap and define an enclosed space within said strap for receiving said padding layer, said inner layer extending substantially flat across the full width of said strap and beyond the opposite side edges of said padding layer.

10. A construction according to claim 8 wherein said inner load-bearing layer and said outer surface layer extend substantially flat across the width of said strap in the relaxed condition thereof, said padding layer and said inner surface layer defining a substantially flat, wide, body-engaging surface area centered between the opposite side edges of said strap in the relaxed condition thereof, whereby said strap lies flat against the supporting body portion of a user and resists curling from edge to edge thereof.

11. A construction according to claim 1 wherein said strap has a wide intermediate strap portion of substantial length between opposite end portions of said strap, said intermediate portion tapering inwardly from edge to edge thereof as it approaches said opposite end portions so that said opposite end portions are substantially narrower than said intermediate portion.

12. A carrying strap construction comprising:

a first thin, soft, pliable strip forming a first surface layer of said strap;

a second thin, soft, pliable strip overlying said first strip and forming a second surface layer of said strap;

a resilient layer of padding material of greater thickness than said surface layers sandwiched between said surface layers;

a thin, flexible strip of high-strength material resistant to stretching forming an inner load-bearing layer of said strap between said padding layer and one of said surface layers and extending across the full width of said padding layer, said inner load-bearing layer having substantially the same overall width edge to edge of said strap as the adjacent said surface layer, and edge-stitching means extending through said first and second surface layers and said load-bearing inner layer at the opposite side edge portions of said strap and along the length thereof to stitch together said surface and inner layers and enclose said layer of padding, such that said surface and inner layers extend together throughout substantially the full width and length of said strap end securement means attaching said surface layers and said load bearing inner layer to each other at their ends and for attachment to a load carrying means.

* * * * *